US007168407B2

(12) United States Patent
Ono et al.

(10) Patent No.: US 7,168,407 B2
(45) Date of Patent: Jan. 30, 2007

(54) OPERATION UNIT OF ENGINE

(75) Inventors: Ryou Ono, Saitama (JP); Takashi Oniwa, Saitama (JP); Hiroshi Hokari, Saitama (JP)

(73) Assignee: Komatsu Zenoah Co., Saitama (JP)

( * ) Notice: Subject to any disclaimer, the term of this patent is extended or adjusted under 35 U.S.C. 154(b) by 0 days.

(21) Appl. No.: 11/228,626

(22) Filed: Sep. 16, 2005

(65) Prior Publication Data

US 2006/0054125 A1 Mar. 16, 2006

(30) Foreign Application Priority Data

Sep. 16, 2004 (JP) ..... 2004-269350

(51) Int. Cl.
*F02N 11/08* (2006.01)

(52) U.S. Cl. ..... 123/179.1; 123/179.3; 180/65.2

(58) Field of Classification Search ..... 123/179.1, 123/179.3, 339.13; 701/112, 113; 180/65.2, 180/65.5

See application file for complete search history.

(56) References Cited

U.S. PATENT DOCUMENTS 5,524,589 A * 6/1996 Kikkawa et al. ..... 123/396
5,551,395 A * 9/1996 Isaacs et al. ..... 123/339.13
5,611,312 A * 3/1997 Swanson et al. ..... 123/436
5,735,243 A * 4/1998 Asai et al. ..... 123/396

* cited by examiner

*Primary Examiner*—Willis R. Wolfe, Jr.
*Assistant Examiner*—Johnny H. Hoang
(74) *Attorney, Agent, or Firm*—Everest Intellectual Property Law Group; Michael S. Leonard

(57) ABSTRACT

An operation unit is provided with an engine operation box storing a control operation portion controlling an opening degree of a throttle valve and a start switch terminal connected to a start motor; a throttle operating lever for controlling the opening degree from an idle position to a full-open position; and a start switch connecting and disconnecting the start switch terminal, wherein the throttle operating lever has a switch shielding portion which enables to operate the start switch without an interference between the throttle operating lever and an operating portion of the start switch when the throttle operating lever is at an idle position, and disables to operate the start switch by shielding at least a part of the operating portion of the start switch by means of a part of the throttle operating lever when the throttle operating lever is operated to be apart from the idle position.

2 Claims, 6 Drawing Sheets

OPERATION UNIT OF ENGINE

BACKGROUND OF THE INVENTION

1. Field of the Invention

The present invention relates to an operation unit structured by unitizing a throttle operating lever of an engine and a start switch which can be applied to various working devices provided with an engine as a source of power and a self starter such as a trimmer, a chain saw, a rotation saw or the like, or a power spreader, various farm working machines or the like, and more particularly to an operation unit of an engine which eliminates an erroneous operation of the start switch based on a simple mechanism.

2. Description of the Related Art

An engine provided with a self-starter actuates a start motor by operating a start switch, and starts the engine based on the actuation. A rotation speed of the engine is controlled by operating a throttle lever so as to control an opening degree of a throttle valve via a control wire. When the rotation speed of the engine reaches a predetermined rotation speed, a clutch within a clutch housing engages so as to start an actuation of a rotary blade or the like. When stopping the rotation of the engine, an engine stop switch is turned on. In conventional, the start switch and the engine stop switch are independently provided, however, for example, according to a switch apparatus described in Japanese Utility Model Application Publication (JP-Y) No. 1-22194, a single movable contact having three contact points is provided, the contact is structured such that a pressure button rotating an operation knob and actuating a start switch provided within the operation knob is pressure actuated to a terminal side, an engine stop switch is changed between a stop position and a working position based on the rotating operation of the knob, and the start switch and the stop switch are composed such that an OFF state, that is, a stop state of the engine is maintained even if the pressure button is pushed at a time when the stop switch is at the stop position, and the engine is started by pushing the pressure button only when the stop switch is at the working position.

Further, for example, according to Japanese Utility Model Application Publication (JP-Y) No. 7-5233, an apparatus is structured by a throttle operating lever, a start and stop operating lever, one control wire in which one end is coupled to the throttle operating lever, and an interlocking mechanism controlling an opening degree of the throttle valve, an actuation of a start switch actuating a start motor and an actuation of an engine stop switch interlocking with a working state of the control wire. Further, a start safety lock lever is arranged near the throttle operating lever. The throttle operating lever, the start and stop operating lever and the start safety lock lever are arranged in a handy operating portion intensively.

In the engine control apparatus according to JP-Y No. 7-5233, the opening degree of the throttle valve of the engine is controlled from an idle position to a full-open position based on the operation of the throttle operating lever. The start and stop operating lever is at a reference position which can be freely operated by the throttle operating lever, is moved to a stop position locking to the start safety lock lever so as to stop the engine, and is moved further to a start position after releasing the lock by the start safety lock lever so as to start the engine. Further, the one control wire is actuated in correspondence to an operated state of the throttle operating lever and the start and stop operating lever, and the interlocking mechanism controls the opening degree of the throttle valve, the actuation of the start switch actuating the start motor and the actuation of the engine stop switch stopping the engine, interlocking with the working state of the control wire.

According to the engine control apparatus, when operating the throttle operating lever and the start and stop operating lever in accordance with a required procedure, the working state is transmitted to the interlocking mechanism via the one control wire, the opening degree of the throttle valve, the actuation of the start switch and the actuation of the engine stop switch are controlled by the interlocking mechanism in correspondence to the working state, and the engine is controlled to a desired start or stop state, or a desired rotation speed. Further, since the throttle operating lever and the start and stop operating lever are provided in the operating portion in the working machine, and the interlocking mechanism, the start switch and the engine stop switch are provided in the prime mover portion, it is possible to control all of the engine start and stop and the rotation speed by the handy portion. Accordingly, an operability is excellent, an electric wiring to the start switch and the engine stop switch can be simplified, and a connecting line connecting the operating portion and the prime mover portion can be constituted only of the one control wire so as to improve an outer appearance.

Meantime, the composite switch apparatus disclosed in JP-Y No. 1-22194 mentioned above is structured such that the start switch of the self-starter and the engine stop switch are integrally installed and composed, however, the start switch is turned on by pushing the start button, for example, unless the operating knob for the engine stop switch is rotated to the stop position, so that the engine rotation starts. Accordingly, it is required to make certain of the fact that the operating knob is not at the stop position every time when it is intended to start the engine. Further, according to JP-Y No. 1-22194 at this time, there is no description which directly associates the operation of the throttle operating lever operating so as to open and close the throttle valve of the engine with the composite switch apparatus as far as it is determined based on the drawings thereof. Accordingly, even if the throttle operating lever is in the operated state, the working device such as the rotary blade or the like is actuated by pushing the start button as mentioned above.

On the other hand, according to the engine control apparatus described in JP-Y No. 7-5233 mentioned above, there is no risk that the working device or the like is erroneously actuated as far as the throttle operating lever and the start and stop operating lever is not erroneously operated. However, its mechanism and operating procedures are extremely complicated and troublesome, an accuracy of parts is required, and it is troublesome to maintain the parts. Further, the erroneous operation tends to be generated in the throttle operating lever and the start and stop operating lever, it is hard to simply start and stop the engine itself, and a smooth operation is expected only by persons of experience in the art.

SUMMARY OF THE INVENTION

An object of the present invention is to provide an operation unit which can securely avoid an erroneous operation and an erroneous actuation tending to be generated between the start switch of the self-starter and the throttle operating lever as mentioned above, and in which the start switch and the throttle operating lever are integrally installed, with an extremely simple structure.

The object can be achieved by a basic structure of the present invention, that is, an operation unit starting an engine via a start motor and controlling an engine rotation, comprising: an engine operation box storing therein a control operation portion controlling an opening degree of a throttle valve of the engine and a start switch terminal connected to an inner side of a drive circuit of the start motor starting the engine; a throttle operating lever provided in an outer portion of the engine operation box and operating the control operation portion so as to control the opening degree of the throttle valve from an idle position to a full-open position; and a start switch connecting and disconnecting the start switch terminal, wherein the throttle operating lever has a switch shielding portion which enables to operate the start switch without an interference between the throttle operating lever and an operating portion of the start switch at a time when the throttle operating lever is at an idle position, and disables to operate the start switch by shielding at least a part of the operating portion of the start switch by means of a part of the throttle operating lever at a time when the throttle operating lever is operated so as to be apart from the idle position.

Further, in accordance with a preferable aspect, the throttle operating lever is rotatably supported to the operation box around one end portion thereof serving as a rotation center, has the switch shielding portion in a rotation end portion, and is structured such that the switch shielding portion rotates between the idle position on the operation box and an upper position of a portion in which the start switch is provided.

In general, the engine start by a self-starter drives the start motor for starting the engine by operating the start switch in the case that the opening degree of the throttle valve is equal to or less than a predetermined opening degree. The engine is started by a rotational drive of the start motor. At this time, since the engine is rotated at a lower speed than a predetermined speed, a clutch is not connected to the working devices, and the engine continues rotating without actuating the working devices. In this case, if the opening degree of the throttle valve is opened to the idling opening degree or more by operating the throttle operating lever, the engine rotation is increased to a rotation speed at which the engine rotation is automatically connected to the working devices by means of the actuation of the clutch, and the actuation of the working devices is started.

However, if the start switch is carelessly turned on, for example, in a state in which the throttle valve is opened to the opening degree equal to or more than the predetermined opening degree by erroneously operating the throttle operating lever before operating the start switch, the engine immediately starts high speed rotation, thereby actuating the working devices from the beginning of the engine start, for example, via a centrifugal clutch or the like. Accordingly, an excessive danger is generated.

On the contrary, in accordance with the basic structure of the present invention, since the throttle operating lever does not interfere with the start switch at a time when the throttle operating lever is at the idle position, it is possible to operate the start switch, and if the switch is turned on in this state, the start motor is driven and can start the engine. At this time, since the engine speed does not reach the predetermined rotation speed, the engine rotation is not connected to the actuation of the working devices. Further, in the case of erroneously operating the throttle operating lever so as to move the lever to the position apart from the idle position before turning on the start switch, a part of the throttle operating lever covers and shields a part of an operation surface of the start switch from the above in the present invention. Accordingly, it is impossible to touch the operation surface of the start switch by a finger even if it is intended to turn on the start switch, so that it is impossible to turn on the start switch. Therefore, since an operator takes note of operating the throttle lever, the operator returns the throttle operating lever to the idle position and thereafter operates the start switch again so as to start the engine.

In other words, according to the present invention, the throttle operating lever interrupts until the throttle operating lever is returned to the idle position, so that it is impossible to operate the start switch. Further, in this case, if the start switch is provided with an engine stop switch portion, the engine is not ignited even by operating the start switch and it is impossible to start the engine, by operating the engine stop switch portion, for example, in a stop switch structure provided with the same structure as JP-Y No.1-22194 mentioned above, by rotating an operation knob for the stop switch portion to the stop position. Further, even if the engine is under operation, it is possible to immediately stop the engine on the ground by rotating the engine stop switch portion to the stop position.

Further, as in the preferable embodiment mentioned above, if the shielding portion is provided in a part of the throttle operating lever rotating around one end serving as the rotation center in the switch box, the start switch is placed on a rotation locus thereof, and the shielding portion is formed in such a shape and at such a position that the shielding portion always covers the upper surface of the operation surface of the start switch when the shielding portion existing at a reference position (an idle position) is moved, the shielding portion shields the operation surface of the start switch at the same time of rotating the throttle operating lever. Accordingly, it is possible to securely disenable to operate the start switch, and it is possible to prevent the engine and the working devices from being carelessly actuated.

DESCRIPTION OF THE PREFERRED EMBODIMENT

A description of a preferable embodiment in accordance with the present invention will be specifically given below based on an illustrated embodiment.

Figure 1:
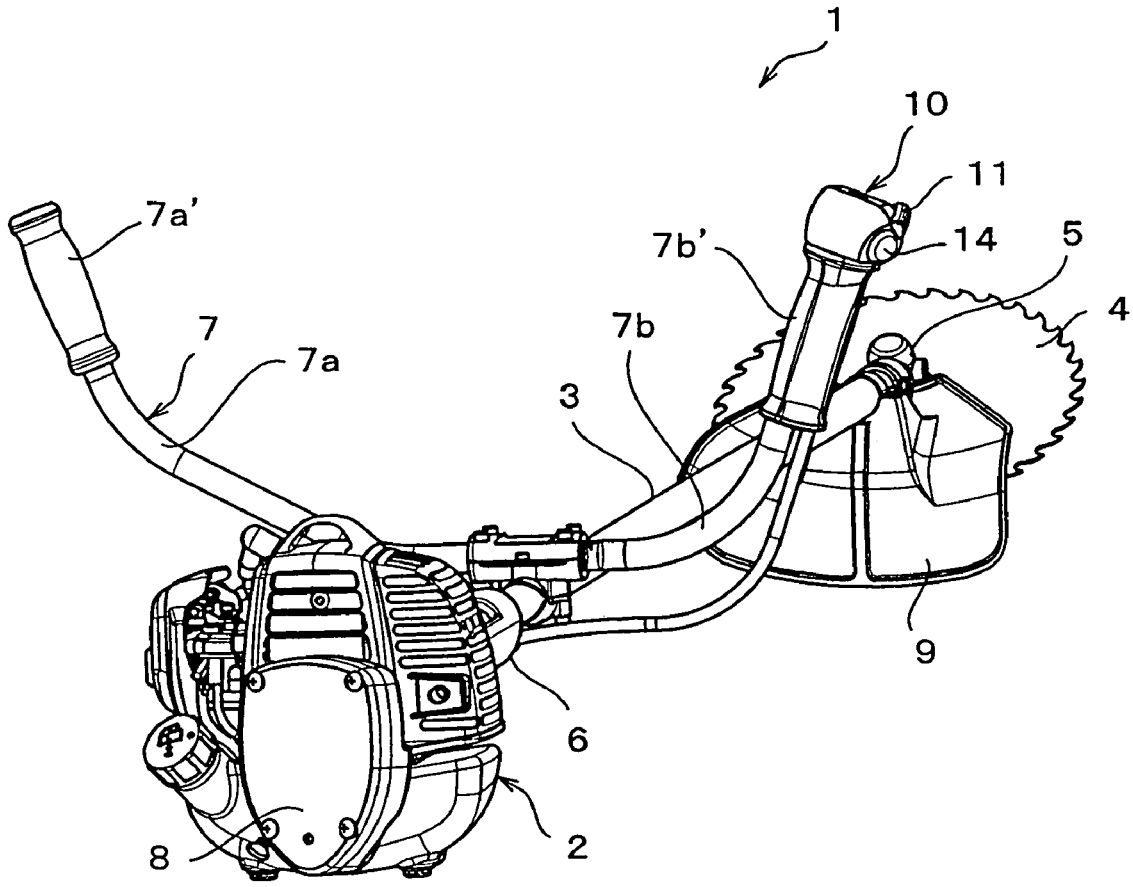
FIG. 1 is a perspective view of a bush cutter to which the present invention is applied, as seen from a back surface side.

FIG. 1 is a bush cutter provided with a self-starter corresponding to a typical embodiment in which an operation unit according to the present invention is attached to a handle portion.

The bush cutter 1 mentioned above is provided with an engine portion 2, a long lever 3 corresponding to a long operation lever, and a rotary blade 4. A long driven shaft (not shown) constituted of a metal rod is inserted into the long lever 3, and a base end portion of the long lever 3 is coupled to the rotary blade 4 via a gear housing 5. A bevel gear mechanism (not shown) is arranged in an inner portion of the gear housing 5. On the other hand, a base end portion of the long lever 3 is coupled to the engine portion 2 via a clutch housing (not shown). Further, a grip 6 doubling as a suspended portion suspended to a part of a harness (not shown) is attached to a position adjacent to the clutch housing in a base end portion of the long lever 3. Further, an operating handle 7 of the bush cutter 1 is fixedly provided in adjacent to a rotary blade side corresponding to a front side of the grip 6 doubling as the suspended portion. A main body of a self-starter 8 is fixedly provided in a back face of the engine portion 2. In this case, reference numeral 9 in the drawing denotes a dustproof member.

The operating handle 7 is extended to right and left sides with respect to the long lever 3, and is constituted of a pipe member in which an apical end portion is raised up to an obliquely upper side, and operation grip portions 7*a*' and 7*b*' made of hard rubber or the like are fixedly provided in apical ends of left and right handles 7*a* and 7*b*. In accordance with an illustrated embodiment, an operation unit 10 of an engine according to the present invention is attached to an upper end of the right operation grip 7*b*'. Operating members such as a throttle operating lever 11, a start switch 14 and the like are attached to the operation unit 10. The operating members are respectively coupled to the engine portion 2 and a start motor (not shown) placed in the self-starter 8, via a throttle wire and a lead wire which are not illustrated, and various operations at a time of starting the engine and after starting the engine can be executed by the operating members arranged in the operation unit 10.

FIGS. 2 to 5 show the operation unit 10 corresponding to a typical embodiment in accordance with the present invention. The operation unit 10 according to the present embodiment is assembled in a single box 12. Based on FIGS. 2 and 4, the box 12 is formed in a hollow rectangular shape having an upper wall portion 12*a* formed in a circular arc shape so as to extend along a rotation of a throttle operating lever 11, first to fourth side wall portions 12*b* to 12*e* in four sides of the upper wall portion 12*a*, and a lower wall portion 12*f*. In an inner portion of the box 12, there are interiorly provided a part of a throttle wire (not shown) controlling an opening degree of a throttle valve of an engine (not shown) in correspondence to a rotating operation amount of the throttle operating lever 11, and a switching terminal (not shown) starting and stopping a start motor (not shown) provided in the self-starter 8 by a switching operation of the start switch 14.

A half portion of a second side wall portion 12*c* of the upper wall portion 12*a* is formed as a depressed portion 12*a*' open to an upper portion of the second side wall portion 12*c*, and a bottom surface of the depressed portion 12*a*' is formed as a horizontal surface. The start switch 14 is attached to the depressed portion 12*a*'. A depth of the depressed portion 12*a*' is set approximately equal to a height of an outer exposed position of the start switch 14, and an upper surface of the start switch 14 forms an upper surface position of the upper wall portion 12*a* of the box 12. Further, insertion and attachment holes 12*c*' and 12*e*' for the operation lever 3 having an approximately equal shape as an outer diameter of the operation lever 3 of the bush cutter 1 are respectively formed in a penetrating manner in center portions of the second and fourth side wall portions 12*c* and 12*e* arranged so as to face to each other in the box 12. As mentioned above, in order to firmly fix and integrate in a state in which the operation lever 3 is inserted to the insertion and attachment holes 12*c*' and 12*e*', it is preferable to divide the box 12 into two pieces, employ a boss connection structure and fasten by a bolt or the like. Further, a throttle wire drawing port 12*c*' (not shown) is formed in a corner portion of the second side wall portion 12*b* of the box 12 close to the third side wall portion 12*c* to which the throttle operating lever 11 is supported.

Figure 2:
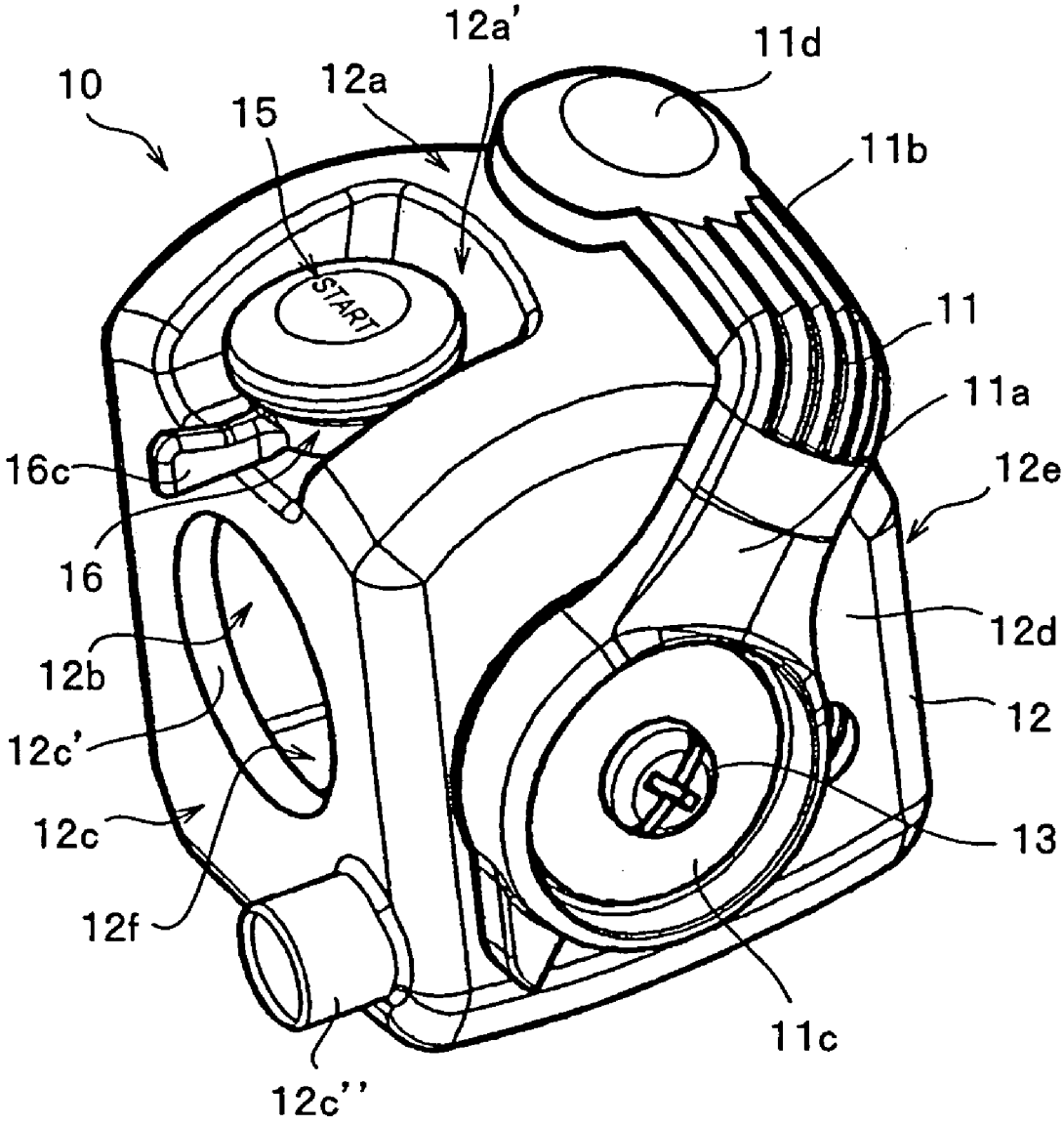
FIG. 2 is a perspective view showing an outer appearance in the case that a throttle operating lever of an operation unit of an engine corresponding to a typical embodiment of the present invention is at an idle position.
Figure 3:
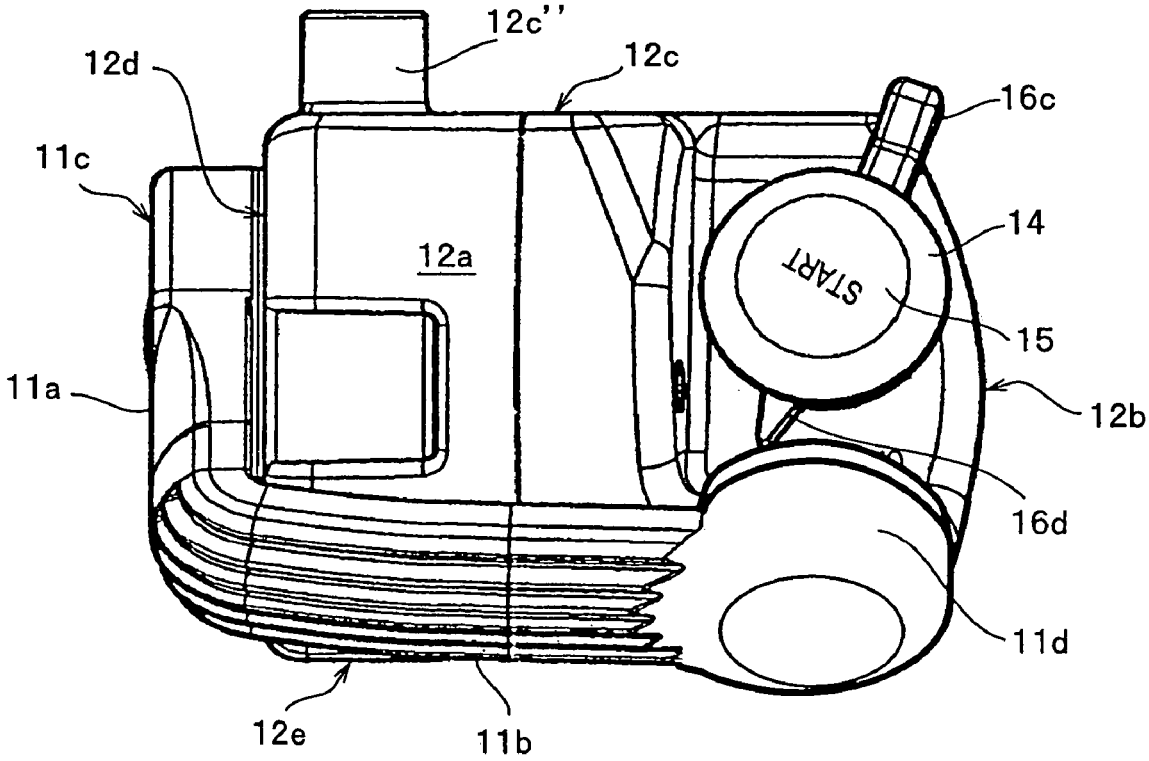
FIG. 3 is a plan view of the operation unit as seen from a start switch side in the case that the lever is at the idle position.
Figure 4:
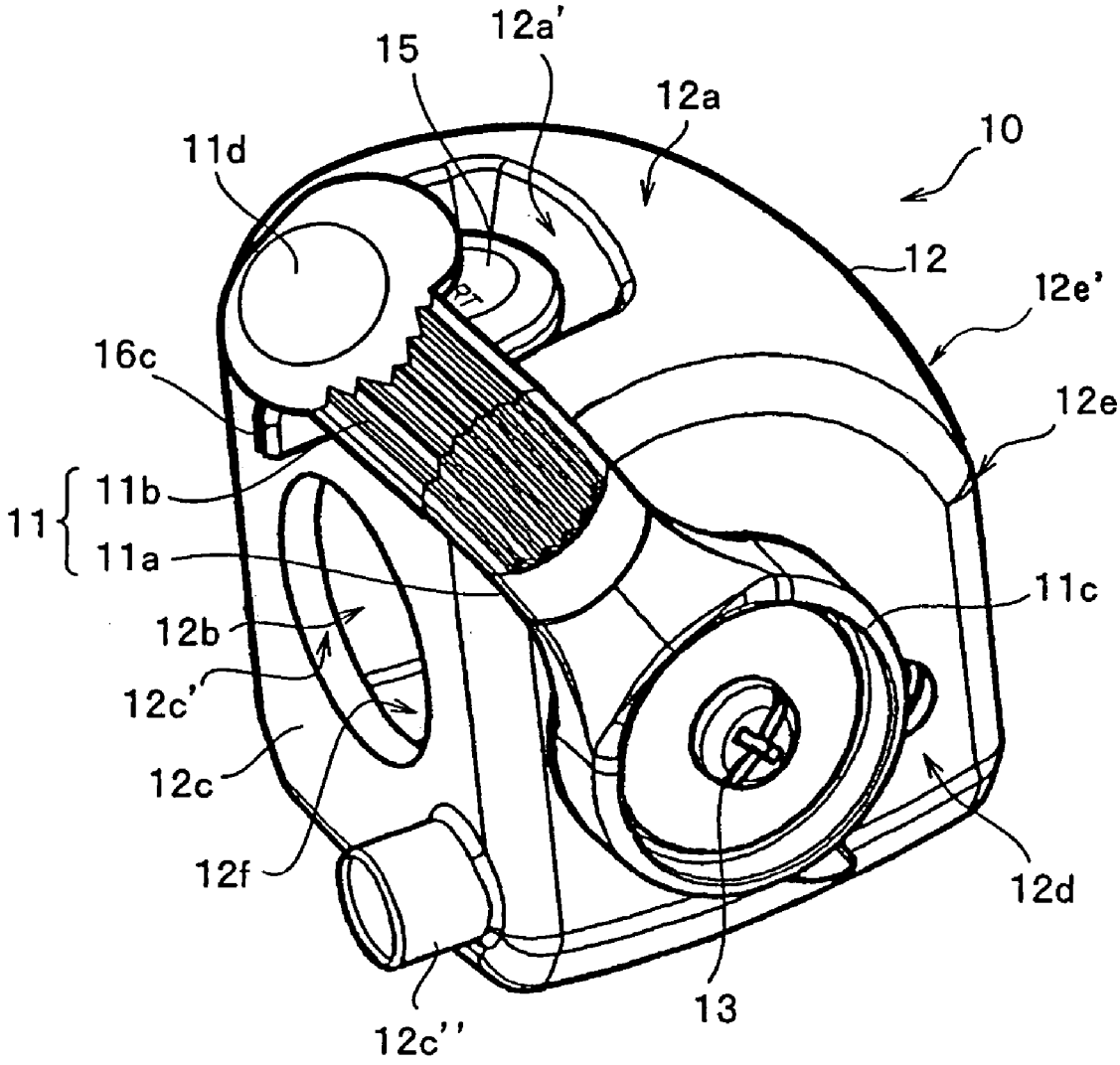
FIG. 4 is a perspective view showing an outer appearance in the case that the throttle operating lever of the operation unit is apart from the idle position.
Figure 5:
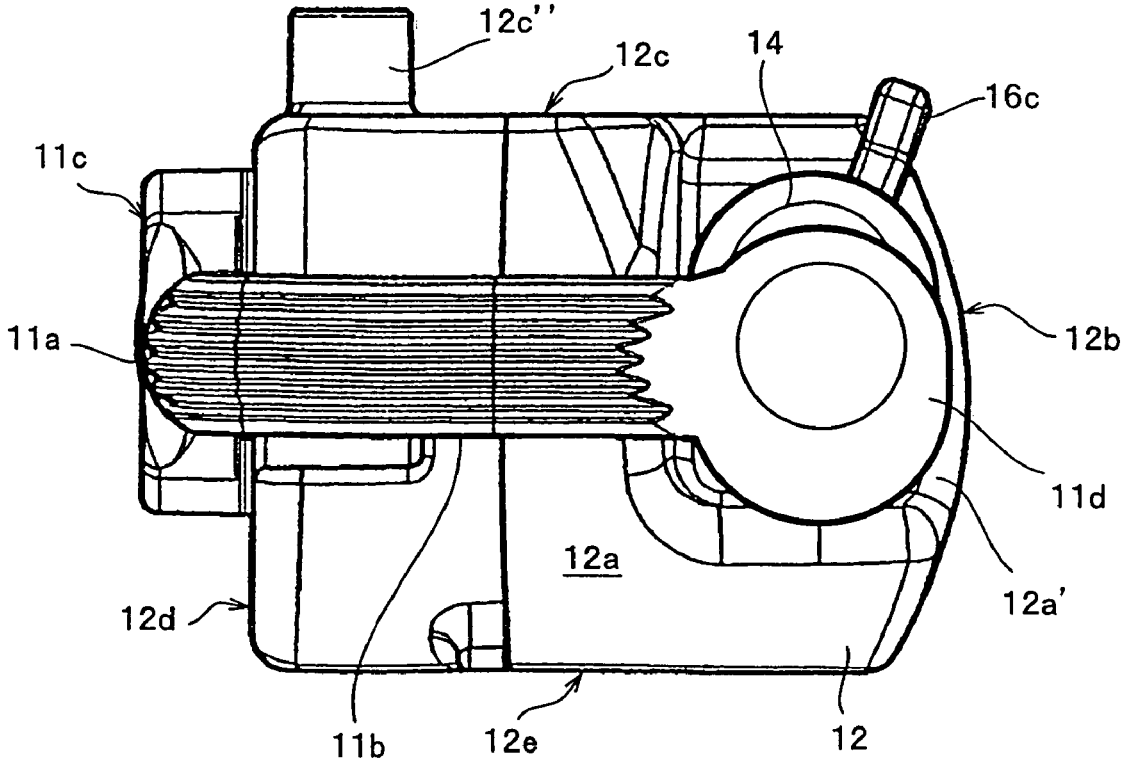
FIG. 5 is a top elevational view of the operation unit as seen from the start switch side in the case that the lever is apart from the idle position.

The throttle operating lever 11 and the start switch 14 are arranged in the upper wall portion 12*a* and the third side wall portion 12*d* of the box 12. The throttle operation lever 11 forms an L-shaped lever constituted by a first lever portion 11*a* in which one end portion is formed in an approximately center portion of the third side wall portion 12*d* of the box 12 and the other end portion has a length reaching the circular arc shaped upper wall portion 12*a*, and a second lever portion 11*b* which is bent approximately at 90 degree in the other end portion of the first lever portion 11*a* and extends to a portion near an opposite edge portion to the upper wall portion 12*a*. In accordance with an illustrated embodiment, a base end portion of rotation of the first lever portion 11*a* arranged approximately in the center portion of the third side wall portion 12*d* is formed as a flanged disc 11*c* as shown in FIGS. 2 and 4, and a bolt insertion hole to which the bolt 13 is inserted is formed in a center thereof. Further, a substantial oval plate portion 11*d* whose center is deflected toward a side of the second side wall portion 12*c* of the box 12 is formed in an apical end portion of rotation of the second lever portion 11*b*. The bolt 13 fastens an end supporting member of the unshown throttle wire disposed in the box and the throttle operating lever 11 via an unshown nut so as to be rotatable interposing the box.

Figure 6:
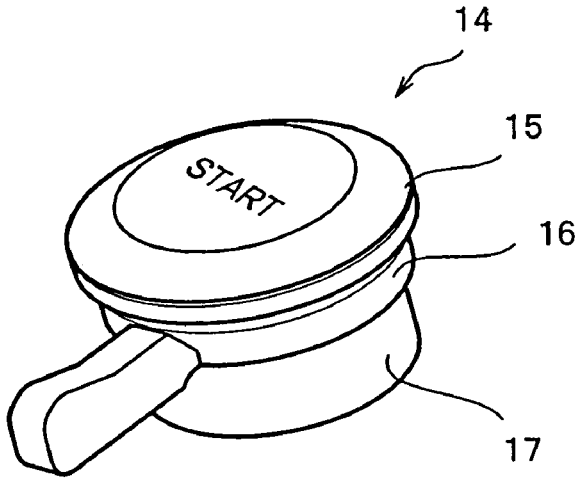
FIG. 6 is a perspective view of an entire showing one example of a start switch attached to the unit.
Figure 7:
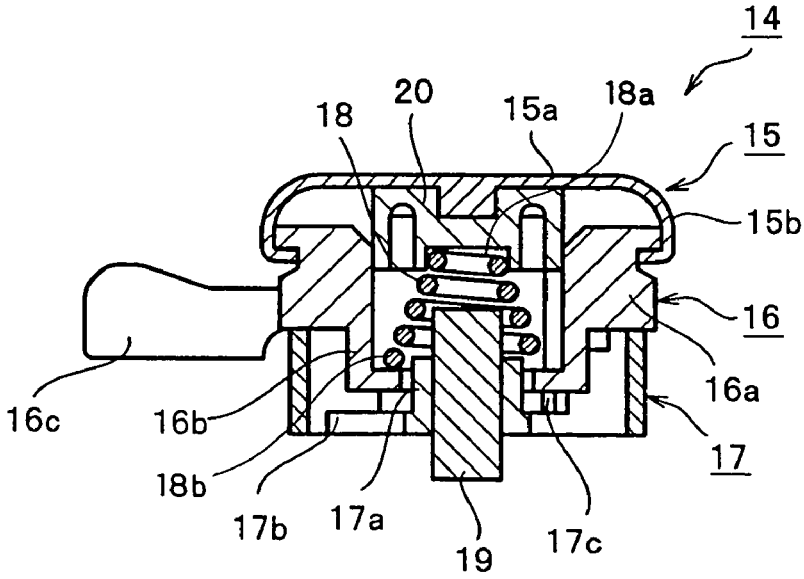
FIG. 7 is a cross sectional view showing an example of an internal structure of the start switch.

FIGS. 6 and 7 show an example of the start switch 14. The start switch 14 has similar appearance to a capped tube body having an open lower surface, a pressure portion 15 serving as a second box, an engine stop switch portion 16 and a cylindrical base portion 17 are sequentially arranged in a pressing direction, and a compression spring 18 and a pin-shaped terminal member 19 are arranged in series in hollow portions thereof.

The pressure portion 15 is formed in a cap shape having a peripheral wall portion 15*b* serving as an attachment portion extended toward the pressing direction from a peripheral edge of a disc portion 15*a*, and an end portion of the peripheral wall portion 15*b* is bent to an inner side so as to be fixed to the engine stop switch portion 16 so as to be slidable and rotatable. The engine stop switch portion 16 is structured such that a peripheral surface thereof is constituted of a hollow body in which a large-diameter portion 16*a* and a small-diameter portion 16*b* are coupled via a step in a direction of a center line, a rotation knob 16*c* is protruded from a part of the large-diameter portion 16*a*, and an indication projection 16*d* is provided in a protruding manner in an opposite side to the rotation knob 16*c*. On and off positions by the engine stop switch portion 16 are expressed on a leading end rotation circumference of the indication projection 16*d* in the attachment portion 15*b* of the start switch 14. The cylindrical base portion 17 supports a lower face outer peripheral edge portion of the large-diameter portion 16*a* of the engine stop switch portion 16 from a lower side so as to be slidable and rotatable. The cylindrical base portion 17 is fixedly provided so as to be fitted to the attachment portion 15*b* of the second box 15. A plurality of arm portions 17*b* extending in a radial pattern to an inner peripheral surface of a lower end portion of the cylindrical base portion 17 are integrally formed in the cylindrical base portion 17, while arranging a cylindrical thread portion 17*a* screwing and supporting the pin-shaped terminal member 19 in a center in the lower end opening surface of the cylindrical base portion 17.

The pin-shaped terminal member 19 is screwed into the cylindrical thread portion 17*a*, and an upper end thereof is protruded to an upper side from an upper end of the cylindrical thread portion 17*a*. Further, a lower end of the pin-shaped terminal member 19 is protruded to a lower side from a lower end of the cylindrical thread portion 17*a*. Although an illustration is omitted, to a lower end portion of the pin-shaped terminal member 19, an end portion of a lead wire (not shown) extending from the start motor (not shown) and a contact terminal (not shown) are attached to the inner portion of the box 12 as already described, and a part of the contact terminal and the pin-shaped terminal member 19 are connected via a short lead wire. A retainer 20 supporting an upper end of the compression spring 18 is attached to the disc portion 15*a* of the cap-shaped pressure portion 15, an upper end of the compression spring 18 is fixed to the retainer 20, and a lower end of the compression spring 18 is loaded and fixed to a flange portion 17*c* formed in a peripheral surface of an upper end portion of the cylindrical thread portion 17*a*.

The compression spring 18 comprises a small-diameter spiral portion 18*a* and a large-diameter spiral portion 18*b*, an upper end of the small-diameter spiral portion 18*a* is fixed to the retainer 20 arranged in the cap-shaped pressure portion 15, and a lower end of the large-diameter spiral portion 18*b* is fixed to the flange portion 17*c* of the cylindrical thread portion 17*a*. An inner diameter of the small-diameter spiral portion 18*a* is set to be smaller than a diameter of the pin-shaped terminal member 19, and an inner diameter of the large-diameter spiral portion 18*b* is set to be larger than the diameter of the pin-shaped terminal member 19. An end portion of another lead wire extending from the start motor (not shown) is firmly coupled to the large-diameter portion 18*b* of the compression spring.

In accordance with the start switch 14 having the structure mentioned above, the cap-shaped pressure portion 15 and the engine stop switch portion 16 are normally at upper positions due to a spring force of the compression spring 18, and are moved to a lower side together with the retainer 20 by pressing the cap-shaped pressure portion 15 against the spring force of the compression spring 18. When the start switch 14 is in the normal state, an upper end portion of the pin-shaped terminal member 19 inserted into the inner portion of the compression spring 18 exists in an inner portion of the large-diameter spiral portion 18*b* of the compression spring 18 in a non-contact state, and does not reach the small-diameter spiral portion 18*a*. In this case, when pushing the cap-shaped pressure portion 15, the compression spring 18 is compressed and the small-diameter spiral portion 18*a* is moved in the pushing direction. By this movement, the upper end portion of the pin-shaped terminal member 19 is brought into contact with the small-diameter spiral portion 18*a* and a passage for the start motor is to be conductive, and the start motor (not shown) is activated.

On the other hand, the engine stop switch portion 16 is guided by a lower end edge of the cap-shaped pressure portion 15 around a center axis line of the start switch 14 so as to be independently rotated, by operating the rotation knob 16*c*. By the rotation, an ignition coil of an ignition circuit becomes in a connection state or a disconnection state, and set a spark plug to an ignition fire state or an extinguished fire state. Under the ignition fire state, the apical end of the indication projection 16*d* of the engine stop switch portion 16 indicates an indication position ON expressed in the start switch attachment portion 15*b*, as shown in FIG. 6, and under the extinguished fire state, the apical end of the indication projection 16*d* indicates an indication position OFF.

Further, the engine operation unit 10 according to the embodiment 1 of the present invention provided with the structure mentioned above is fixedly provided, for example, in any (the right operation grip portion 7*b*' in the illustrated embodiment) of the operation grip portions 7*a*' and 7*b*' arranged in a apical end portion of the operation handle 7*a* and 7*b* of the bush cutter 1, as already mentioned. When it is intended to start the engine, if the engine stop switch portion 16 is at the OFF position, the engine is not started even by pushing the start switch 14. If the indication projection 16*d* indicates the ON position by rotating the engine stop switch portion 16, it is possible to start the engine by pushing the start switch 14. However, in accordance with the present embodiment, even if the indication projection 16*d* indicates the ON position, the engine is not always started only by pushing the start switch 14.

In other words, according to the present embodiment, if it is intended to push the start switch 14 at a time when the throttle operation lever 11 is at the idle position, it is possible to push the start switch 14 and it is possible to start the engine because the substantially oval plate portion 11*d* formed in the apical end portion of the rotatable throttle operating lever 11 do not exist above the start switch 14. Accordingly, in the case that the throttle operating lever 11 is apart from the idle position so as to be at the position opening the throttle valve, the substantial oval plate portion 11*d* of the throttle operating lever 11 covers the cap-shaped pressure portion 15 of the start switch 14, so that it is impossible to push the cap-shaped pressure portion 15. As a result, the start motor can not be driven until the throttle operating lever 11 is returned to the idle position, and the engine can not be rotated. Accordingly, it is possible to prevent the rotary blade 4 from being carelessly actuated.

In the case of pushing the start switch 14 after confirming that the throttle operating lever 11 is at the idle position, the start motor is driven so as to start the engine. After the engine start is confirmed, the pushing operation of the start switch 14 is released. Therefore, the start switch 14 is disconnected and the start motor is stopped, however, the engine continues an idling rotation.

In this case, when rotating the throttle operating lever 11 in a counterclockwise direction in FIG. 2 from the idle position, the throttle wire is drawn to the inner portion of the box 12 in correspondence to the rotation amount of the throttle operating lever 11 via the wire drawing portion 12*b*' of the box 12, which increases the opening degree of the throttle valve (not shown) so as to increase the rotation speed of the engine and rotates the rotary blade 4. In the case that the work is finished and the engine is stopped, the engine is immediately stopped by operating the operation knob 16*c* of the engine stop switch portion 16 such that the indication protruding portion 16*d* indicates the OFF position.

As is understood from the description mentioned above, according to the operation unit of the engine based on the present invention, since the throttle operating lever and the start switch including the engine stop switch are installed within the case so as to be unitized, it is not necessary that the throttle operating lever, the engine stop switch and the start switch are provided in the machine body in a separated manner, and the unit can be attached intensively in the handy handle portion. Accordingly, it is possible to easily carry out the operation itself of the working devices. Further, particularly, in accordance with the present invention, since the start switch is effective only when the throttle operating lever is at the idle position, the engine is not started even if the start switch is operated in the state in which the throttle operating lever is moved, so that it is possible to securely eliminate the erroneous actuation caused by the erroneous operation without paying any specific attention, and it is possible to secure a further safety.

In this case, the present invention is not limited to the embodiment mentioned above, but, for example, it goes without saying that the shape and the structure of the throttle operating lever and the start switch can be variously changed, and the interlocking mechanism between the throttle operating lever and the throttle wire or the like can be appropriately changed within the scope of claims. For example, in the case that the pressure portion 15 exists in the side wall portion 12*d*, the oval plate portion 11*d* may be arranged in the first lever portion 11*a*.

What is claimed is:

1. An operation unit starting and stopping an engine via a start motor and controlling an engine rotation comprising:

an engine operation box storing therein a control operation portion controlling an opening degree of a throttle valve of the engine and a pair of start switch terminals connected to the start motor starting the engine;

a throttle operating lever provided in an outer portion of the engine operation box and operating the control operation portion so as to control the opening degree of the throttle valve from an idle position to a full-open position; and an operating portion of a start switch connecting and disconnecting the pair of start switch terminals, wherein the throttle operating lever has a switch shielding portion which enables to operate the start switch without shielding the operating portion of the start switch at a time when the throttle operating lever is at the idle position, and disables to operate the start switch by shielding at least a part of the operating portion of the start switch by means of a part of the switch shielding portion at a time when the throttle operating lever is operated so as to be apart from the idle position.

2. The operation unit according to claim 1, wherein the throttle operating lever is rotatably supported to the operation box around one end portion thereof serving as a rotation center, the switch shielding portion is disposed on a side of the other end portion of the throttle operating lever and rotates between a position for shielding the operating portion of the start switch and a position for not shielding the operating portion of the start switch.

* * * * *